US005983979A

United States Patent [19]

Miki

[11] Patent Number: 5,983,979

[45] Date of Patent: Nov. 16, 1999

[54] HOT CHAMBER DIE CASTING MACHINE FOR ALUMINUM AND ITS ALLOYS

[75] Inventor: Isao Miki, Shizuoka, Japan

[73] Assignee: Sanki Company, Shizuoka, Japan

[21] Appl. No.: 08/907,667

[22] Filed: Aug. 8, 1997

[30] Foreign Application Priority Data

| | | | |
|---|---|---|---|
| Sep. 6, 1996 | [JP] | Japan | 8-255286 |
| Feb. 27, 1997 | [JP] | Japan | 9-058549 |
| Feb. 27, 1997 | [JP] | Japan | 9-058550 |

[51] Int. Cl.[6] ..... B22D 17/04

[52] U.S. Cl. ..... 164/316; 164/138

[58] Field of Search ..... 164/316, 317, 164/318, 312, 309, 310, 311, 113, 138

[56] References Cited

U.S. PATENT DOCUMENTS

| | | | |
|---|---|---|---|
| 3,319,702 | 5/1967 | Hartwig et al. | 164/316 |
| 4,091,970 | 5/1978 | Komiyama et al. | 164/316 |
| 4,482,001 | 11/1984 | Smedley et al. | 164/113 |
| 4,556,098 | 12/1985 | Hintermann et al. | 164/316 |
| 4,614,630 | 9/1986 | Pluim, Jr. | 264/219 |
| 4,704,079 | 11/1987 | Pluim, Jr. | 425/190 |
| 4,730,658 | 3/1988 | Nakano | 164/113 |
| 4,749,021 | 6/1988 | Nakano | 164/316 |
| 5,350,007 | 9/1994 | Miki et al. . | |

FOREIGN PATENT DOCUMENTS

| | | | |
|---|---|---|---|
| 40-40-81255 | 3/1992 | Japan | 164/316 |
| 5-57368 | 7/1993 | Japan . | |
| 6-142872 | 5/1994 | Japan . | |

*Primary Examiner*—Patrick Ryan
*Assistant Examiner*—Anjan Dey
*Attorney, Agent, or Firm*—McAulay Nissen Goldberg Kiel & Hand, LLP

[57] ABSTRACT

A hot chamber die casting machine for casting aluminum and its alloys includes separated ceramic parts, namely a ceramic injection cylinder constituting a pump body, a ceramic outer sleeve, a ceramic injection pipe, and a metallic or thermet flange avoiding a large one piece ceramic body and stress concentrations at critical points. The outer sleeve holds the injection cylinder together with the injection pipe in the molten metal. The flange is fixed to a structure which is outside of and independent from a molten metal container and a heating furnace, thus temperature fluctuations do not affect this injection apparatus. The flange can also be fixed to the structure to which an injection hydraulic cylinder is secured in such a manner that the centers of the hydraulic cylinder, the plunger and the injection cylinder are aligned to perform a stable injection operation. A seal ring is disclosed between no-parallel conical cone shaped-fitting ends between the injection pipe and the injection cylinder. The seal ring can be partially and permanently deformable by a sealing force at the temperature of molten aluminum or its alloy to avoid a stress concentration at the joint.

19 Claims, 10 Drawing Sheets

HOT CHAMBER DIE CASTING MACHINE FOR ALUMINUM AND ITS ALLOYS

BACKGROUND OF THE INVENTION

1. Field of the Invention

This invention relates to a hot chamber die casting machine for casting aluminum and its alloys, adapted to be employed where metallic injection systems cannot be used because of the erosive property of molten aluminum. Also, this invention relates more particularly to a hot chamber die casting machine using a ceramic injection system composed of four parts avoiding large one piece ceramic body and stress concentrations at critical points, and is made to be fixed to a structure outside of and independent from the molten metal holding container and the metal heating furnace.

2. Description of the Related Art

It is known that a hot chamber die casting process is more useful as compared with a cold chamber die casting process. Therefore, a hot chamber process has been widely used for casting zinc and magnesium alloys, with advantages in the quality of castings and the casting productivity. Particularly, in a hot chamber process, a molten metal goes into a die cavity without being cooled while it passes through the injection sleeve in contact with room temperature sleeve wall and also the molten metal does not pick up gas in contact with oily substance in the sleeve as in a cold chamber process.

Because molten aluminum and its alloys are substantially reactive and able to react with almost all metallic materials and erode them, until now, a hot chamber process using a cast iron injection system, as in the case of zinc and magnesium, could not be employed. Thus, only a cold chamber die casting machine has been used in die casting aluminum and its alloys, although many trials to utilize ceramic injection systems for casting aluminum and its alloys have been reported.

An injection system for molten aluminum and its alloys has to be made of ceramic and/or thermet materials. A conventional hot chamber die casting machine for casting aluminum alloys (such as that disclosed in Japanese Unexamined Utility Model Publication (Kokai) No. 5-57368) is shown in FIG. 15. In the conventional hot chamber die casting machine a furnace or base frame 6 with pot 4 for melting and accommodating molten metal 3 includes heaters 5 for heating the pot 4 to a certain temperature so as to keep the metal in the pot in a molten state. The pot 4, mounted on a base frame 6, is provided with an injection cylinder 1 and an injection pipe 13. The injection pipe 13 has a nozzle 44 which is forced and fastened to a mold 15 and 16 attached to a die-plate 52.

In order to rigidly connect the mold 15 and 16 to the nozzle 44, the base frame 6 is clamped to the die-plate 52 by a clamping means 53, the detailed explanation thereof being omitted. On the other hand, a plunger 12 is inserted in the injection cylinder 1 and the plunger 12 is connected to a hydraulically driven shaft 54 by means of a coupling 32, so that when a hydraulic cylinder moves the shaft 54 downward, the plunger 12 also moves downward to pressurize the molten metal in the injection cylinder 1. Thus, the molten metal flows through the injection pipe 13 and is injected via the nozzle 44 into the mold cavity 18 of the mold 15 and 16 and a casting operation is thus performed.

To secure the alignment of centers of the hydraulically driven shaft 54, the plunger 12 and the injection cylinder 1, the above mentioned conventional system has a fatal disadvantage. Because the injection cylinder 1 sits on the pot 4, the position of the injection cylinder 1 is not stable, since the pot 4 does not have a mechanically precise structure and also the dimension of the pot 4 changes due to a temperature change, for example, when the heater 5 is turned on, the pot 4 tends to expand resulting in a change of position of the injection cylinder 1. When this happens, normal functioning of the injection system is disturbed and the quality of the casting cannot be maintained. Therefore, with the above mentioned system, a frequent repositioning of the pot 4 is inevitable.

Japanese Unexamined Utility Model Publication (Kokai) No. 5-57368 (the present inventor is also one of the inventors of the U.M. registration) discloses a ceramic injection pipe separated from a ceramic injection cylinder and connected to the injection by means of a seal ring between flat surfaces. In this prior art, the seal ring must be compressed by a large axial force in order to seal the molten metal at the joint in a hot chamber die casting machine for aluminum. However, with this mechanism, a small fluctuation of the position of the nozzle part of injection pipe can deteriorate the sealing resulting in unstable operation.

SUMMARY OF THE INVENTION

An object of the present invention is to provide a hot chamber die casting machine for casting aluminum and its alloys, in which a stress concentrations can be prevented from being exerted to a ceramic injection cylinder and a ceramic injection pipe.

According to the present invention, there is provided a hot chamber die casting machine for casting aluminum and its alloys, comprising: a container for containing therein a molten metal of aluminum or its alloys; means for heating the molten metal in the of the cylinder being dipped in the container; a ceramic plunger arranged for reciprocation in the cylinder and operable to inject the molten metal through a ceramic injection pipe and a runner into a die cavity; means for holding the cylinder, the holding means comprising a ceramic outer sleeve for holding the injection cylinder, a metallic or thermet flange arranged outside of the molten metal in the container and holding the outer sleeve and a fixed support structure arranged outside of and independent from the container and the heating means, so that the flange is fixed to the frame structure.

In an embodiment, the injection pipe and the injection cylinder are constructed as separated bodies independent from each other in order to simplify the shape of the outer sleeve; the injection cylinder is provided on its side portion with a concave-shaped molten metal outlet and the injection pipe has a convex-shaped base end; a seal material disposed between the concave-shaped outlet of the injection cylinder and the convex-shaped base end of the injection pipe, so that the injection pipe and the injection cylinder are connected to each other via said seal material by using an external force.

In this case, the concave-shaped outlet of the injection cylinder and the convex-shaped base end of the injection pipe cooperatively define non-parallel conical shape fitting ends of the respective injection cylinder and the injection pipe.

In another embodiment, the injection cylinder and the injection pipe are formed together as a single ceramic body, so that the injection pipe extends outwardly from a side portion of the injection cylinder, and the injection cylinder has a bottom portion thereof which is held in the ceramic outer sleeve.

In an embodiment, the ceramic outer sleeve has narrower bottom parts which hold a bottom of the ceramic injection cylinder in position.

In another embodiment, the ceramic outer sleeve has a pair of rectangular-shaped holes oppositely arranged in a diametrical direction thereof and a separate bottom plate which is held between the pair of holes, so that a bottom of the ceramic injection cylinder is held in position by the bottom plate.

In an embodiment, the flange is made of metal or thermet which has a thermal expansion coefficient smaller than 2 times and larger than 0.5 times a thermal expansion coefficient of a ceramic material of the outer sleeve.

In an embodiment, the fixed support structure has an inner flange portion to which the metallic or thermet flange is fixed and the fixed support structure also holds an injection hydraulic cylinder for actuating the ceramic plunger.

The injection cylinder may have a concave conical cone at the molten metal exit and the separated injection pipe may have a convex conical cone at the molten metal inlet, a seal ring is disposed between these cones, and the cone of the injection cylinder has a vertical angle ($\beta$) smaller than a vertical angle ($\alpha$) of the cone of the injection pipe.

In this case, the seal ring has a cross-section of a polygonal shape.

In one embodiment, a cross-section shape of the molten metal outlet of the injection cylinder is a concave conicoid and a cross-section shape of the molten metal inlet of the injection pipe is a convex conicoid.

The seal ring is made of either one of thermets, ceramics, carbon composites including graphite, stainless steels, heat resistant steels having a property of being partially and permanently deformable by a sealing force under the temperature of molten aluminum alloy and also the seal ring comprises a material which is coated with the coating material having an erosion resistant property against the molten aluminum alloys.

The partially and permanently deformable property of the seal ring is plastic deformation property.

Otherwise, the partially and permanently deformable property of the seal ring is a partially collapsible property.

The vertical angle ($\beta$) of the concave conical cone at the molten metal exit of the injection cylinder is 10 to 60° smaller than the vertical angle ($\alpha$) of the convex conical cone at the molten metal inlet of the separated injection pipe.

In further embodiment, a protection ring is placed between the seal ring and the outlet of molten metal of the injection cylinder, so that the seal ring is protected from a high speed molten metal coming out from the injection cylinder.

In still further embodiment, the injection cylinder is provided at the concave-shaped molten metal outlet with a cap inserting recess and a cap placed at a tip of the injection pipe is inserted into the recess, so that the cap is located next to the seal ring, the cap has a perforated hole so that the molten metal coming out from the injection cylinder enters into the injection pipe without hitting the seal ring, thus the seal ring is protected from erosion by high speed molten metal.

DETAILED DESCRIPTION OF THE EMBODIMENTS

The preferred embodiments of the present invention will now be described in detail with reference to the drawings.

Figure 15:
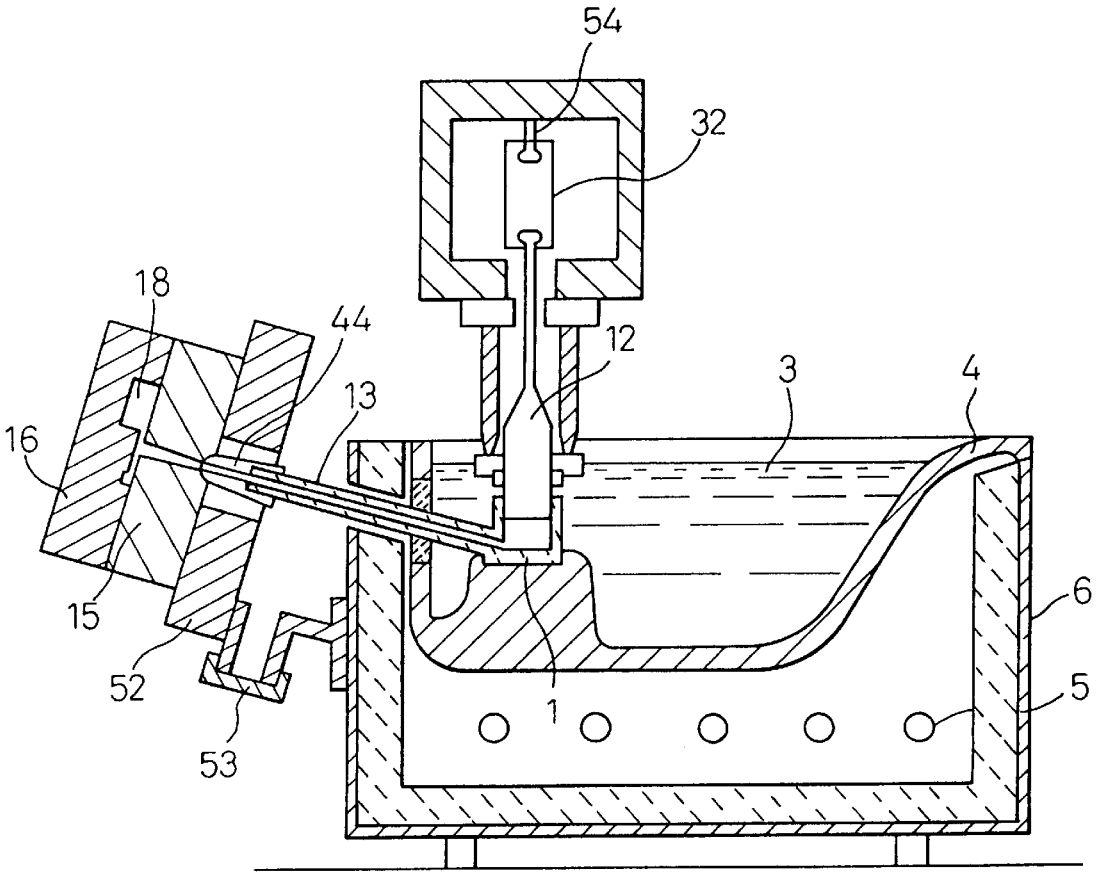
Fig.15 PRIOR ART
FIG. 15 is a vertical cross-sectional view of a hot chamber die casting machine known in the prior art.

The general construction of a hot chamber die casting machine, to which the present invention can be applied to, may be itself the same as shown in FIG. 15, except for those relating to the following description.

Figure 1:
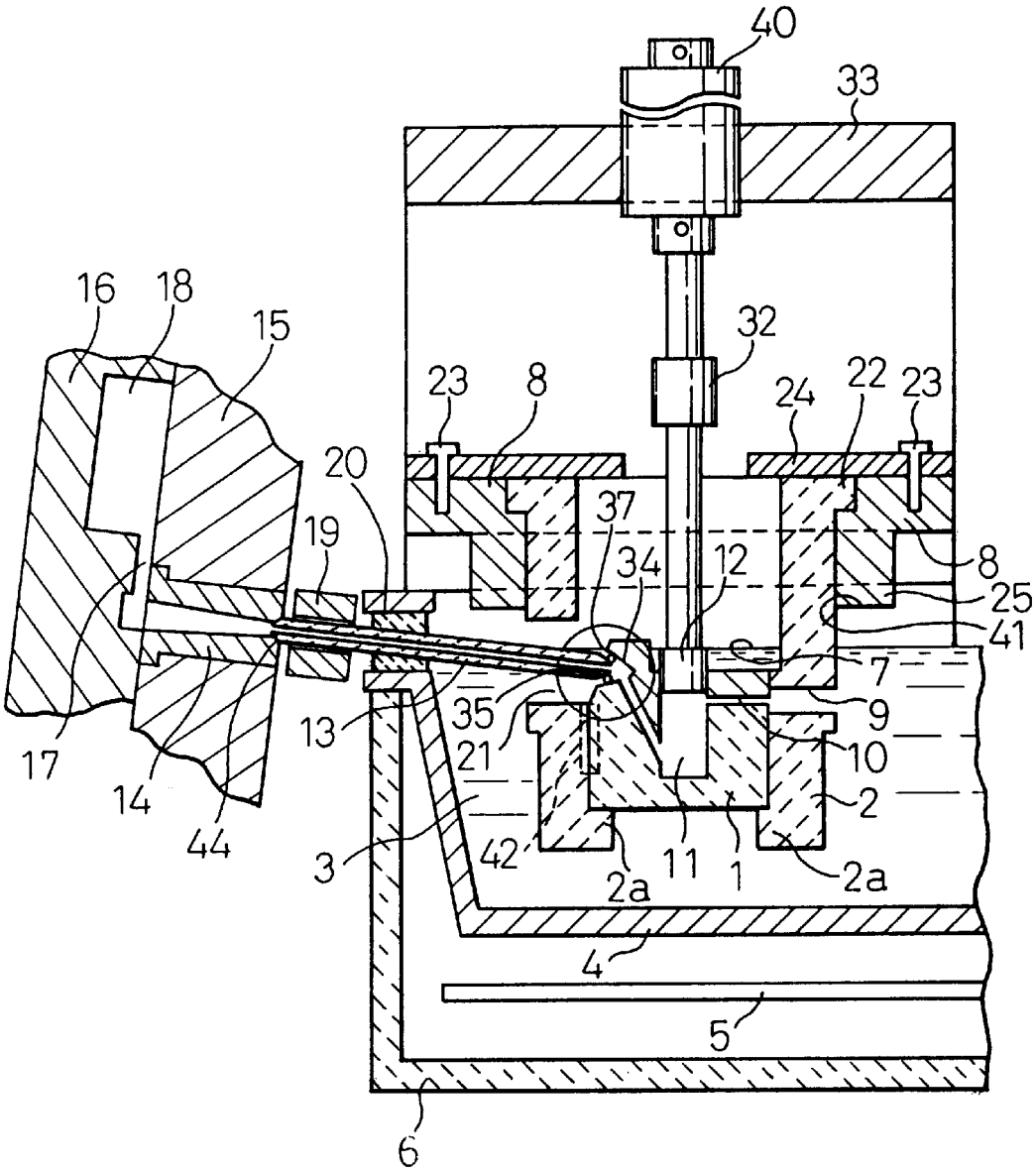
FIG. 1 is a vertical cross-sectional view of a hot chamber die casting machine of this invention, particularly showing a ceramic outer sleeve, a ceramic injection cylinder constituting a pump body, a ceramic injection pipe with a seal ring and a flange.
Figure 2:
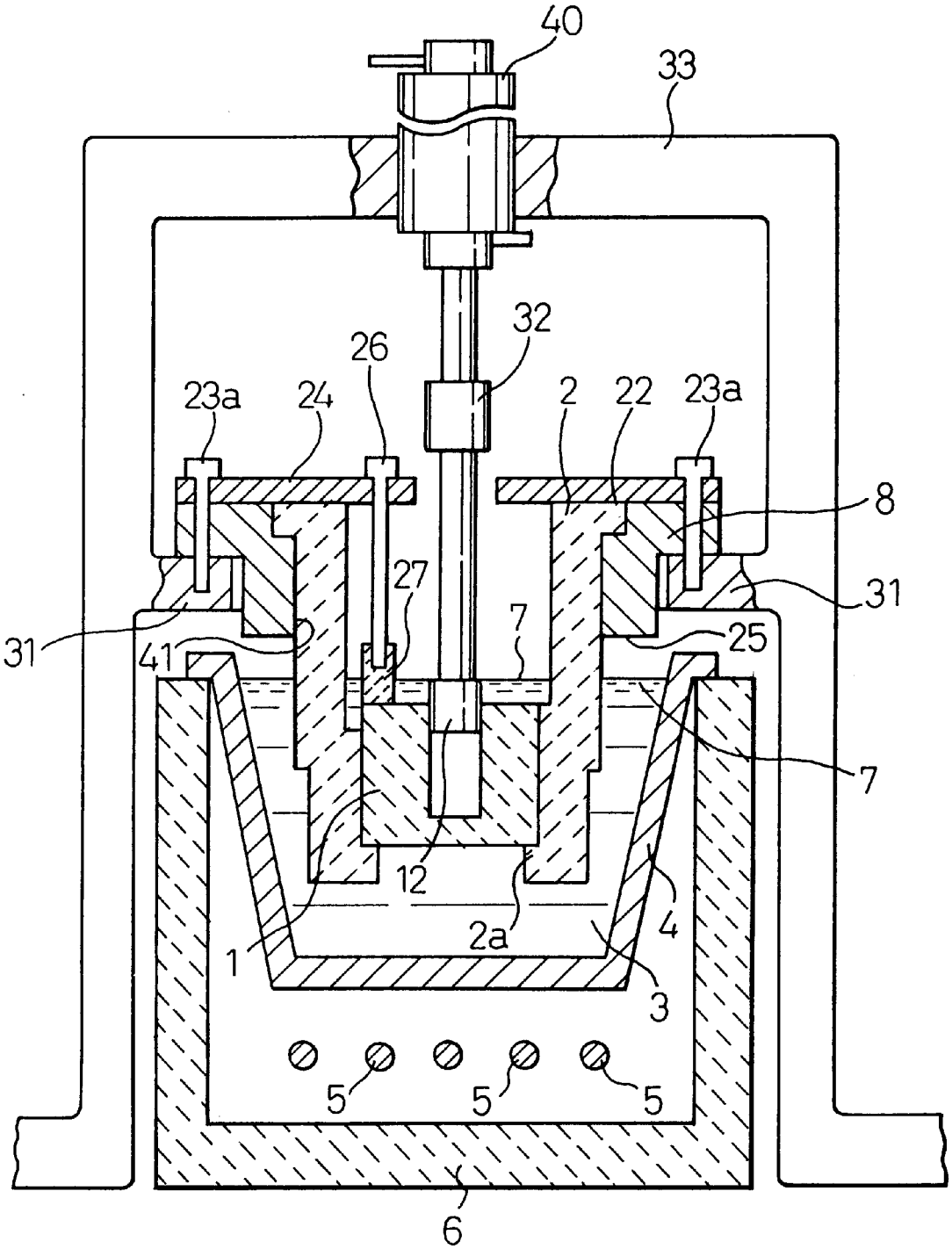
FIG. 2 is a vertical cross-sectional view orthogonal to FIG. 1, showing an upper structure of this machine which holds an injection hydraulic cylinder and the flange.

According to an injection apparatus of the present invention, as shown in FIGS. 1 and 2, a cylindrical injection cylinder 1 made of ceramic is held by a cylindrical outer sleeve 2 which is also made of ceramic. That is to say, the outer sleeve 2 is provided at its bottom portion with a plurality of inner projections or narrow bottom parts 2*a* which cooperatingly hold the bottom of the injection cylinder 1. The injection cylinder 1 is prevented from turning in the outer sleeve 2 by means of a ceramic stopper 42 keyed in an axial groove arranged between the inside wall of the sleeve 2 and the outside wall of the cylinder 1.

The injection cylinder 1 and the outer sleeve 2 are provided at their side walls with respective molten metal inlet ports 10 and 9 which are aligned with each other so as to allow the molten metal 3 of aluminum or its alloys contained in a container 4 to enter into the inside of the cylinder 1 through these ports 10 and 9. On the other hand, the injection cylinder 1 has a molten metal outlet port opened at a concave cone 34 with which a convex cone 35 of an injection pipe 13 which is also made of ceramic is in contact, as will be described later in detail. The outer sleeve 2 is provided at its side wall with an opening or hole 21 through which the injection pipe 13 passes.

The injection pipe 13 is held by a wall of the molten metal container 4 by means of wall of ceramic fiber 20 and a nozzle heater 19. An outlet nozzle 44 of the injection pipe 13 is communicated with a sprue bush 14 disposed in an fixed die 15.

The outer sleeve 2 has an upper flange or projected part 22. A flange 8, made of a metallic material or thermet, fixedly holds the upper portion of the outer sleeve 2. Particularly, the flange 8 has an upper flange portion and a lower part 25 defining a cylindrical inner surface 41 which firmly embraces the upper, outer cylindrical surface of the sleeve 2. The flange 8 is firmly secured to inner projections 31 of a support structure or frame 33 by means of bolts 23*a*, as shown in FIG. 2, in such a manner that the metallic or thermet flange 8 is located outside of the molten metal 3 in the container 4 and away from the surface 7 of the molten metal 3. On the other hand, the injection cylinder 1 is completely positioned under the surface of the molten metal 3 with the lower part of the outer sleeve 2. A fixing plate 24 is also fixed to the flange 8 by means of bolts 23 and 23*a* to stably fix the sleeve 2 to the flange 8. Therefore, the flange 8 and the support structure 33 are located outside of and independent from the container 4 and a heating furnace 6 including heating elements 5, so that they are not affected by the high temperature of the molten metal.

A hydraulic cylinder 40 is held on the support structure 33 referred to as a "saddle structure", and is connected through a coupling 32 to a plunger 12 arranged for reciprocation in the cylinder cavity 11 and operable to inject molten metal 3 in the cylinder cavity 11 which comes from inlet ports 9 of the outer sleeve 2 and also from holes 10 of the injection cylinder 1. The molten metal is pushed into the injection pipe 35 by the movement of the plunger 12 and urged finally into the die cavity 18 through the sprue bush 14 and a runner 17 of a movable die 16. To prevent the injection cylinder 1 from moving up and down due to the reciprocal movement of the plunger 12, as shown in FIG. 2, a restraining bolt 26 is provided in the fixing plate 24 and a ceramic terminal 27 attached to the bottom of the restraining bolt 26 to always push the injection cylinder 1 downward.

According to the present invention, the ceramic injection cylinder 1, the ceramic outer sleeve 2, the ceramic plunger 12 and the ceramic injection pipe 35 are entirely or partially in contact with the molten metal 3. On the other hand, since the flange 8 is outside of the molten metal 3, it can be made of a metallic material and still be free from erosion by the molten aluminum.

Using the casting machine as mentioned above, the fluctuation of the position of the injection cylinder 1 is minimized as compared with the conventional structure, such as shown in FIG. 15, and the alignment of the hydraulic cylinder 40, the plunger 12 and the injection cylinder is kept stable.

The upper structure 33, referred to as a "saddle", holds the injection hydraulic cylinder 40. The flange 8 is fixed to the saddle arm 31, which is a part of the upper structure 33, by means of a fixing plate 24 and fixing bolts 23. An injection cylinder holding bolt 26 and a ceramic terminal 27 are also held by the fixing plate 24. By this structure, the injection cylinder 1 is free from dimensional fluctuations of container 4 which is heated by discontinuous heating by the heating elements 5 to keep the aluminum or its alloy in a molten state (about 620° C. to 670° C.).

In the above embodiment, the injection pipe 13 is inserted through the hole 21 of the outer sleeve 2 and abutted to a molten metal outlet 34 of the side wall of the injection cylinder 1 via a seal ring 37, so that the injection pipe 13 extends laterally, but slightly inclined upward from the side wall of the injection cylinder 1. An external force is exerted to the injection pipe 13 to keep a firm contact between the outlet end of the injection pipe 13 and the sprue bush 14 and between the inlet, base end of the injection pipe 13 and the connecting joint 34 of the injection cylinder 1 so that any molten metal is prevented from leaking at these joint portions.

Figure 3:
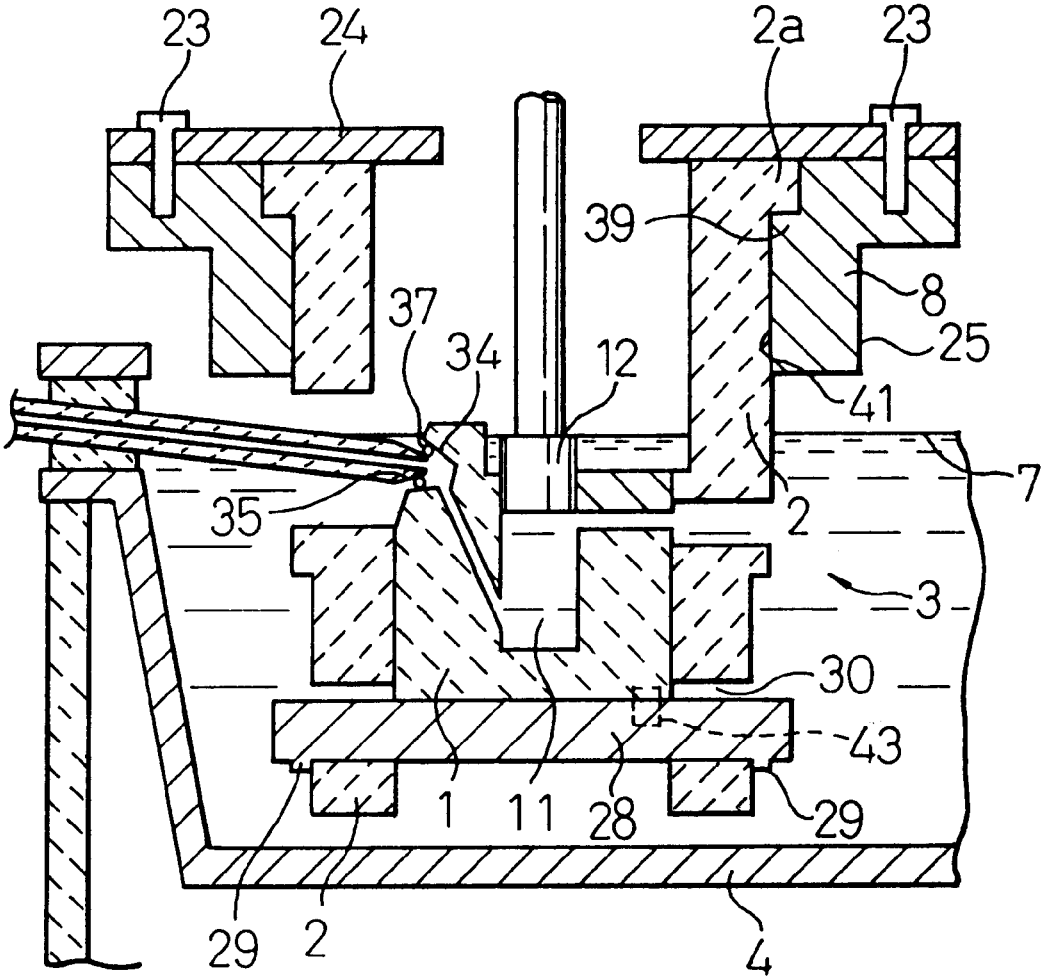
FIG. 3 is an enlarged vertical cross-sectional view showing a modification of the system shown in FIG. 1 with an outer sleeve having a bottom plate and holes for the bottom plate.
Figure 4:
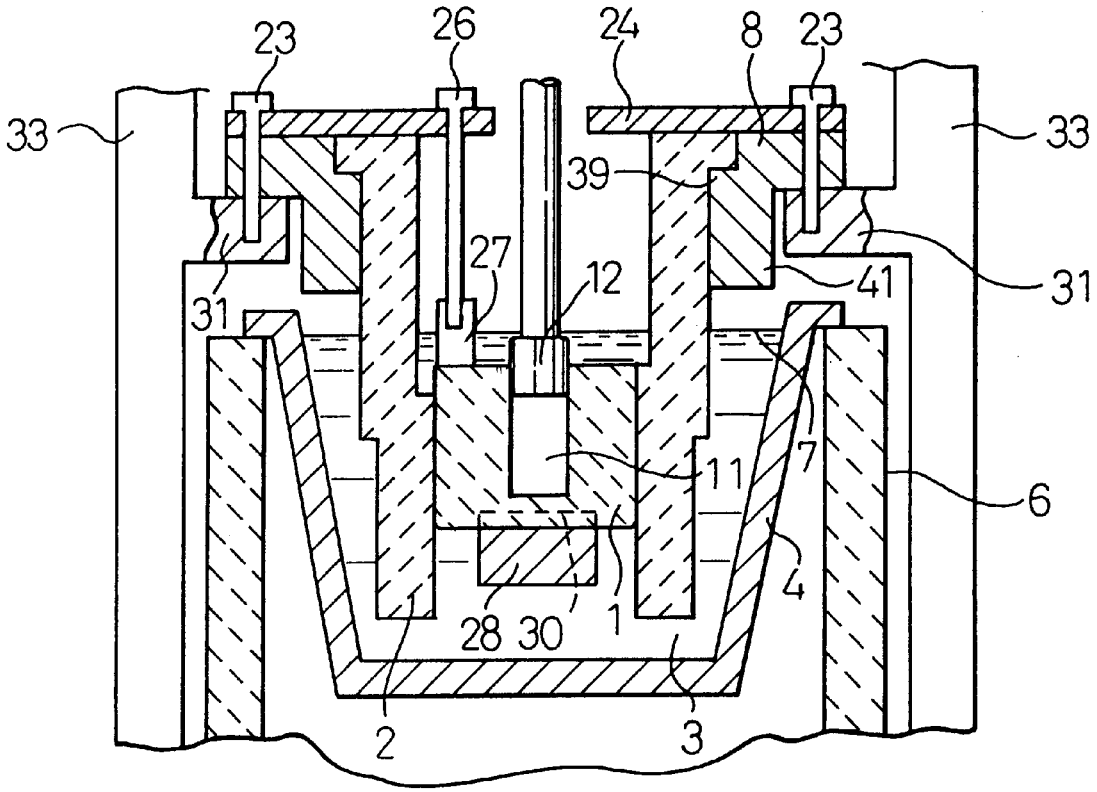
FIG. 4 is a vertical cross-sectional view orthogonal to FIG. 3, showing in cross-section the outer sleeve with the bottom plate and a part of the upper structure holding the flange.

FIGS. 3 and 4 show a modified embodiment of the hot chamber die casting machine shown in FIGS. 1 and 2. In this embodiment, the outer sleeve 2 is provided at the side wall thereof with a pair of holes 30, 30 each having rectangular cross-section and oppositely arranged in the diametrical direction. A bottom plate 28 having a corresponding rectangular cross-section is inserted into the holes 30, 30, so that the injection cylinder 1 is retained in a position. The bottom plate 28 has a pair of prominences 29, 29 which prevent the dislocation of the bottom plate 28. A ceramic stopper 43 is provided for preventing the injection cylinder 1 from turning with respect to the outer sleeve 2. Such a stopper 43 may be, such as, a projection protruded downward from the bottom of injection cylinder and a hole of the bottom plate 28 with which the projection is engaged.

In this embodiment, before the injection cylinder 1 is dipped into the molten metal 3 in the container 4, the injection cylinder 1 can be incorporated with the outer sleeve 2 by means of the bottom plate 28, at the outside of the molten metal 3, and the outer sleeve 2 can be fixed to the support frame 33 by means of flange 8, the fixing plate 24 and the fixing bolts 23.

In the above embodiment, the flange 8 is made of metal or thermet having a low thermal expansion coefficient. Preferably, a thermal expansion coefficient of the flange 8 is smaller than 2 times (preferably, 1.7 times) and larger than 0.5 times (preferably, 0.8 times) a thermal expansion of the ceramic outer sleeve 2. Thus, the flange 8 can be advantageously fit into the ceramic outer sleeve 2.

Figure 5:
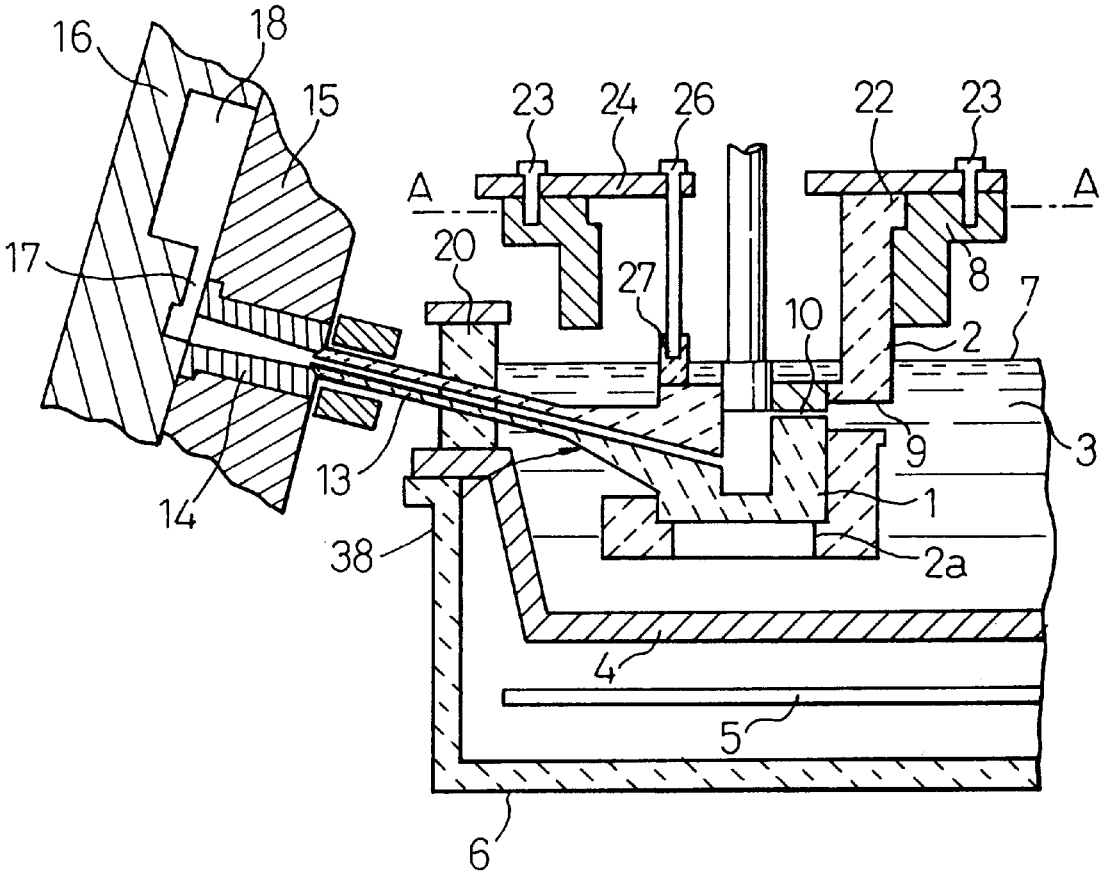
FIG. 5 is a vertical cross-sectional view showing a ceramic outer sleeve and a ceramic injection cylinder which has an injection pipe as one piece body in a smaller machine.

In FIG. 5, the case of a smaller ceramic injection cylinder is shown where the injection pipe 13 is not separated from the injection cylinder 1. That is to say, the injection pipe 13 is unitarily formed with the injection cylinder 1 as a single ceramic body, so that the injection pipe 13 extends from the side wall portion of the injection cylinder 1 toward the lateral direction, but is slightly inclined upward. The outer sleeve 2 has at the bottom 2*a* thereof a smaller diametrical portion 2*a* which holds the injection cylinder 1 in position, in the same manner as the first embodiment shown in FIG. 1. The shape of the outer sleeve 2 is substantially the same as that of the embodiment shown in FIG. 1, except for the following.

Figure 6:
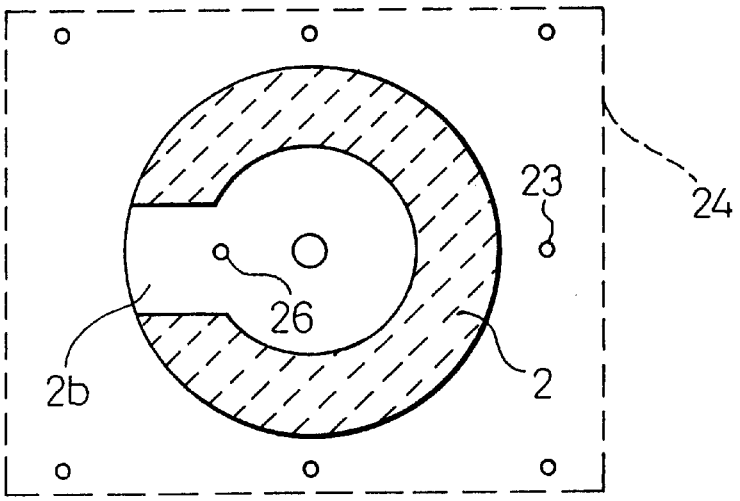
FIG. 6 is a horizontal cross-sectional view of the ceramic outer sleeve taken along line A—A in FIG. 5.

As shown in FIG. 6, the outer sleeve 2 is provided at the side wall thereof with an opening 2*b* axially extending from the upper end thereof, in order to put the injection cylinder 1 with the injection pipe 18 into the outer sleeve 2 from the top. Therefore, opening 2*b* does not extend to the bottom of the outer sleeve 2 having the smaller diametrical portion 2 for holding the injection cylinder 1.

Figure 7:
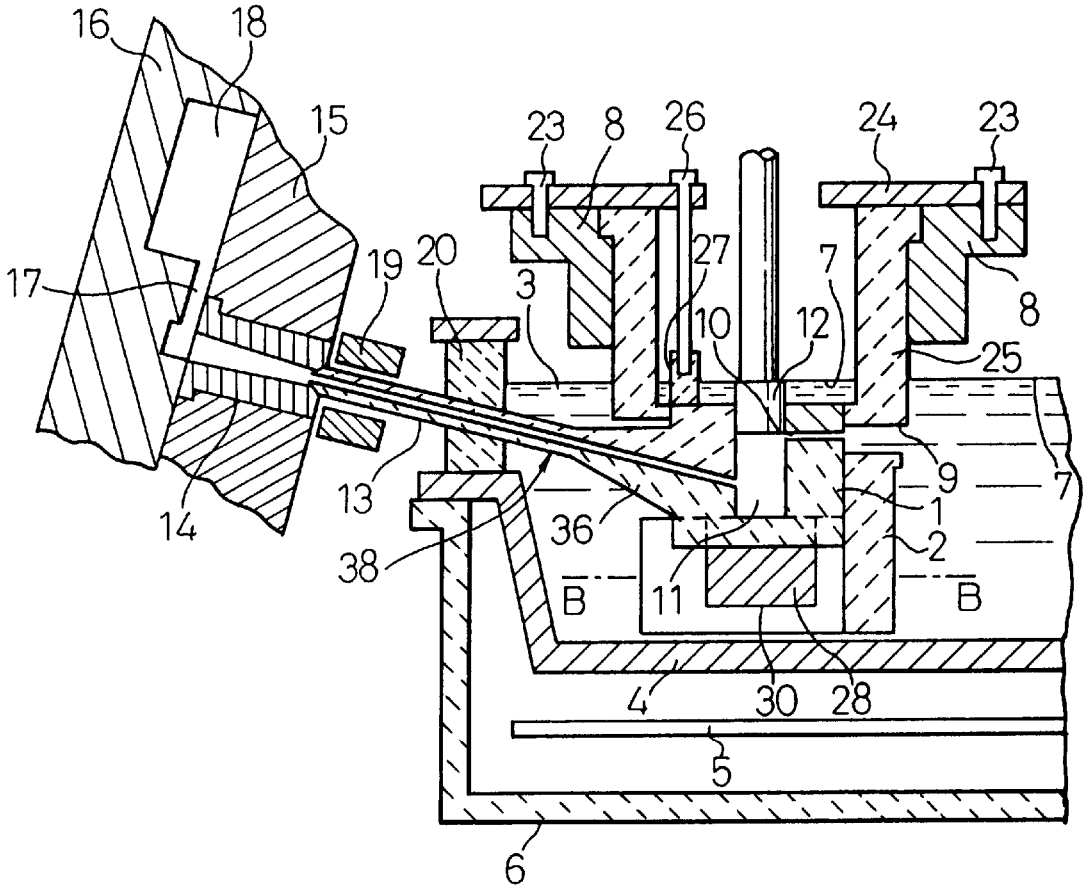
FIG. 7 is a vertical cross-sectional view showing a modification of the system shown in FIG. 5 with an outer sleeve having a bottom plate and holes for the bottom plate.
Figure 8:
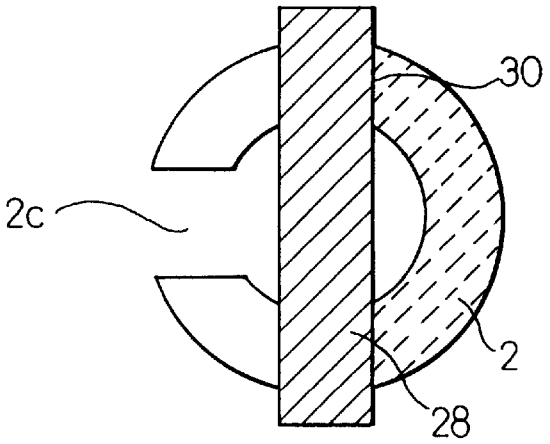
FIG. 8 is a horizontal cross-sectional view of the ceramic outer sleeve taken along line B—B in FIG. 7.

FIG. 7 is a vertical cross-sectional view showing a modification of the embodiment shown in FIG. 5 with an outer sleeve 1 having a bottom plate 28 and holes 30 for the bottom plate 28, in the same manner as the embodiment shown in FIGS. 3 and 4. FIG. 8 is a horizontal cross-sectional view of the ceramic outer sleeve in FIG. 7 at B—B section.

In this embodiment, the outer sleeve 2 is provided at the side wall thereof with an opening 2*c* axially extending from the bottom end thereof, in order to put the injection cylinder 1 with the injection pipe 18 into the outer sleeve 2 from the bottom. No such opening 2*b* extends to the upper part of the outer sleeve 2.

Figure 9:
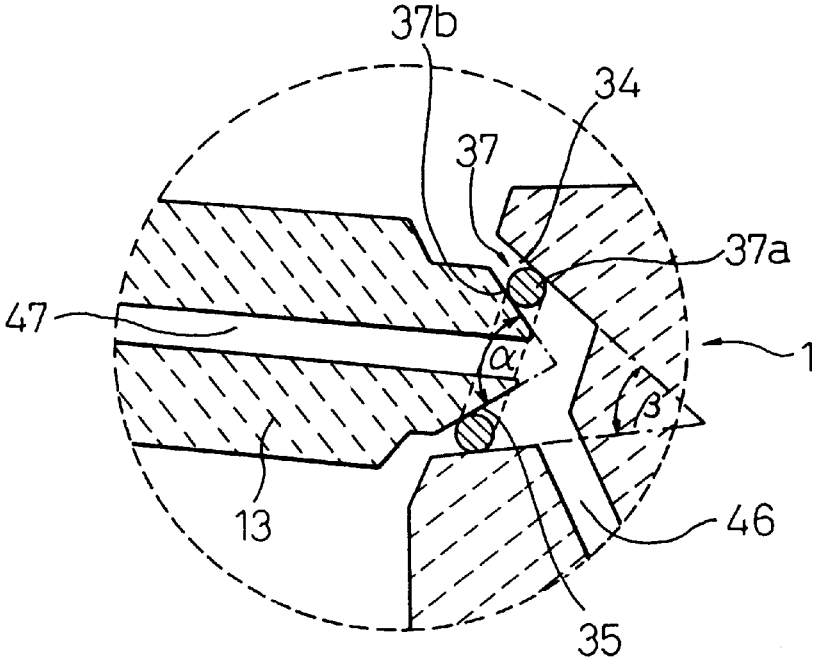
FIG. 9 is a close up vertical cross-sectional view showing the seal ring and conical shaped fitting ends of the injection cylinder and the injection pipe shown in FIG. 1.

FIG. 9 is a close up vertical cross-sectional view of FIG. 1 showing the seal ring 37 which is placed between non-parallel conical shape fitting ends 34 and 35 of the injection cylinder 1 and of the injection pipe 13. The seal ring 37 is compressed by a compression force by which the nozzle 44 (FIG. 1) at the outlet end of the injection pipe 13 is pressed against the die 15 in order to seal the joint between the nozzle 44 and the sprue bush 14 of the die 15, although the mechanism thereof is not illustrated in detail in FIG. 9.

Thus, the seal ring 37 is deformed partly at the point of contact 37*a* of the injection cylinder side and also deformed partly at the point of contact 37*b* of the injection pipe side, resulting in a reliable sealing of the joint between the injection cylinder fitting end 34 and the injection pipe fitting end 35. The reliability of the joint has been proved by numerous experimental tests.

In the embodiment shown in FIG. 9, the injection pipe fitting end 35 is a convex conical cone having a vertical angle ($\alpha$=60° to 120°) and the injection cylinder fitting end 34 is a concave conical cone having a vertical angle ($\beta$=30° to 90°) which is preferably smaller by 20° to 80°, and more preferably by 30° to 60°, than $\alpha$. Thus, the seal ring 37 is preferably deformed by an external force exerted on the injection pipe 13 toward the side wall of the injection cylinder 1. It is preferable that the width of sealing by the deformable seal ring 37 is 0.1 mm to 0.8 mm, or more preferably 0.3 mm to 0.6 mm.

The seal ring 37 can be made of any deformable material, such as thermet, ceramic, any carbon compound, stainless steel, heat-resistant steel. In addition, the seal ring 37 can be coated with any heat-resistant coating material which is endurable against molten aluminum and its alloys.

Figure 10:
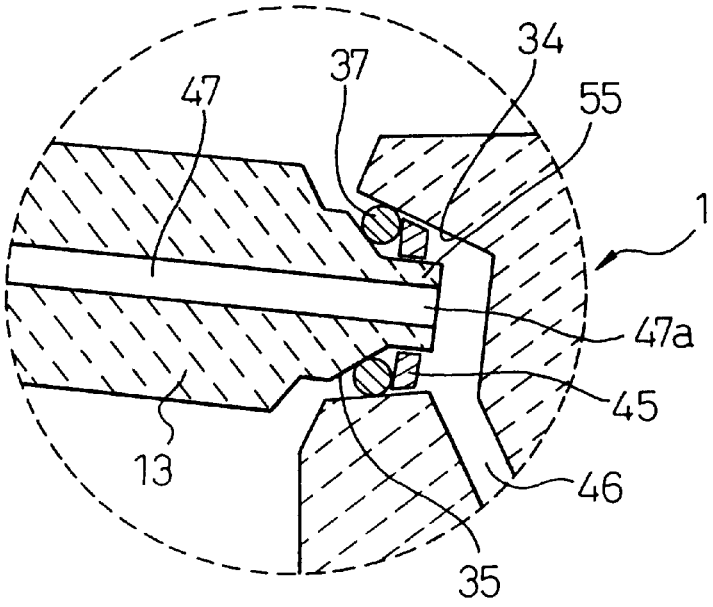
FIG. 10 is a close up vertical cross-sectional view showing the seal ring as in FIG. 9 with a protection ring which protects the seal ring from the turbulent motion of molten metal during the injection and gives a prolonged life to the seal ring.

In an embodiment shown in FIG. 10, the seal ring 37 is protected by a protection ring 45 from erosive molten metal coming out at a high speed from an outlet 46 of the injection cylinder 1 and going into an inlet 47*a* of the injection pipe 13. The protection ring 45 is disposed at the tip, cylindrical inlet end of the injection pipe 13 so as to be adjacent to the seal ring 37 at the side of the injection cylinder 1. Such a protection ring 45 is necessarily be made of a material which is highly endurable against the molten aluminum and its alloy.

Figure 11:
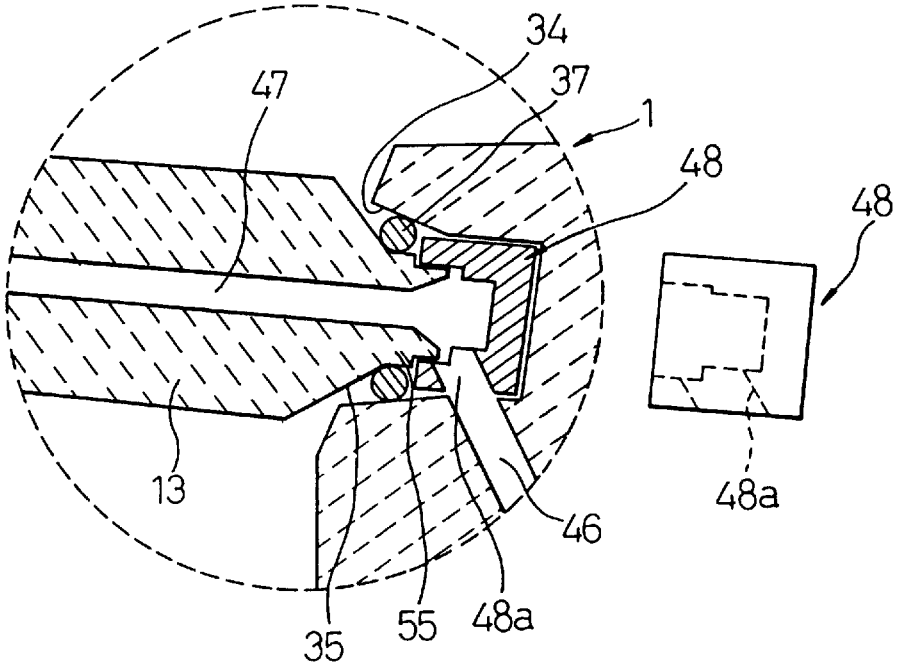
FIG. 11 is a close up vertical cross-sectional view showing the seal ring as in FIG. 5 with a cap which also protects the seal ring from the turbulent motion of molten metal.

In an embodiment shown in FIG. 11, the seal ring 37 is protected by a protection cap 48 from erosive high speed molten metal. The cap 48 is made of ceramics or thermets which have anti-erosive property against molten aluminum. In this embodiment, the injection cylinder 1 is provided at the concave-shaped molten metal outlet with a cap inserting recess. Thus, the protection cap 48 is firmly inserted into the recess, so that the cap 48 is located next to the seal ring 37. The cap has a perforated hole 48*a*, so that the molten metal coming out from the cylinder cavity 11 (FIG. 1) passes through an outlet port 46 of the injection cylinder 1 and a port 48*a* of the cap 48 into the passage 47 of the injection pipe 13.

Figure 12:
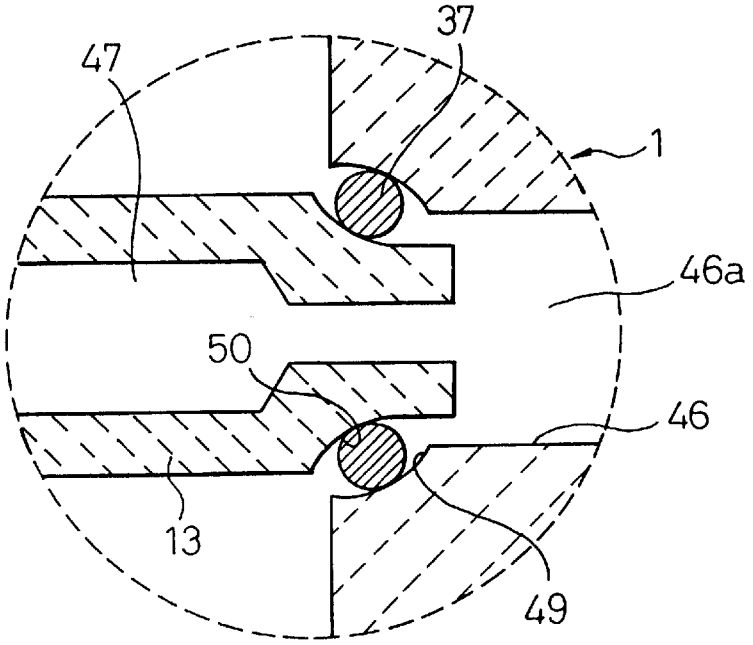
FIG. 12 is a close up vertical cross-sectional view of FIG. 1 showing the seal ring between a concave conicoid of the molten metal outlet of the injection cylinder and a convex conicoid of the molten metal inlet of the injection pipe.

The seal ring 37 can be placed, as shown in FIG. 12, between the molten metal outlet end 46*a* of an injection cylinder 1 having a concave conicoid 49 and the molten metal inlet 47*a* of an injection pipe 13 having a convex conicoid 50.

Figure 13:
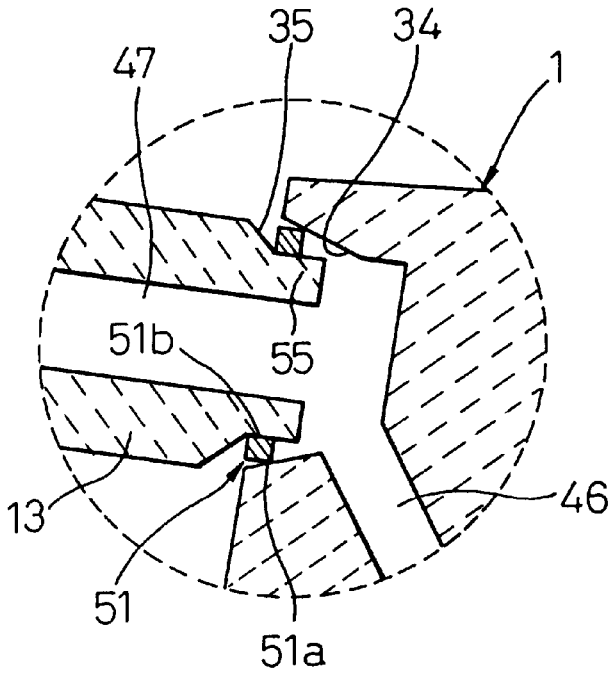
FIG. 13 is a close up view of FIG. 1 showing the seal ring of which cross-section is a rectangular.

The seal ring 37 can have a rectangular cross-sectional shape 51 as shown in FIG. 13 and the point of contacts 51*a* and 51*b* are deformed partly by the same mechanism as explained in the case of FIG. 9, providing reliable sealing.

Figure 14:
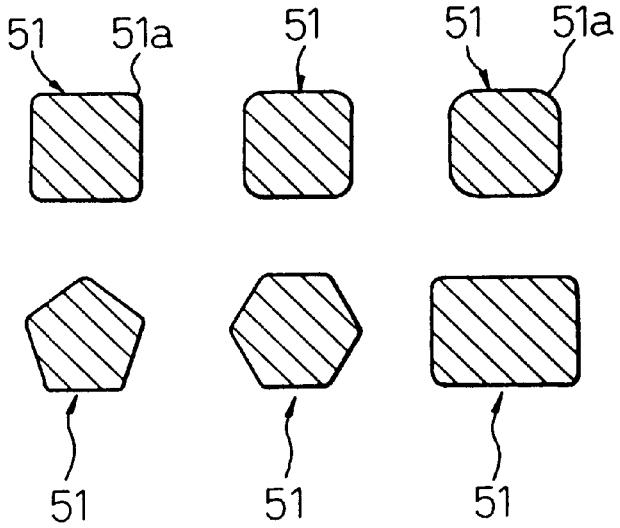
FIG. 14 shows various polygonal cross-sectional shapes of the seal ring.

FIG. 14 shows different shapes of the seal ring 51 which can also be used in the previous embodiments, such as shown in FIG. 9. These seal rings 51 are deformed at each contact point 51*a* and 51*b* with the injection cylinder fitting end and the injection pipe fitting end, as described in the case of FIG. 9, providing reliable sealing.

It should be understood by those skilled in the art that the foregoing description relates to only some of the preferred embodiments of the disclosed invention, and that various changes and modifications may be made to the invention without departing from the spirit and scope thereof.

What is claimed is:

1. A hot chamber die casting machine for casting aluminum and its alloys, comprising:

a container for containing therein a molten metal of aluminum or its alloys;

means for heating said molten metal in the container;

a ceramic cylinder constituting a pump body, at least a part of said cylinder being dipped in said container;

a ceramic plunger arranged for reciprocation in said cylinder and operable to inject the molten metal through a ceramic injection pipe and a runner into a die cavity;

means for holding said cylinder, said holding means comprising a ceramic outer sleeve which has sustaining means for holding said injection cylinder constituting a pump body by enclosing a lower part of said injection cylinder in the molten metal, a metallic or thermet flange arranged outside of the molten metal in the container and holding said outer sleeve and a fixed support structure arranged outside of and independent from said container and said heating means, so that said flange is fixed to said fixed support structure.

2. A die casting machine as claimed in claim 1, wherein:

said injection pipe and said injection cylinder are constructed as separated bodies independent from each other in order to simplify the shape of the outer sleeve;

said injection cylinder is provided on its side portion with a concave-shaped molten metal outlet and said injection pipe has a convex-shaped inlet;

a seal ring disposed between said concave-shaped outlet of the injection cylinder and said convex-shaped inlet of the injection pipe, so that said injection pipe and said injection cylinder are connected to each other via said seal ring by using an external force.

3. A die casting machine is claimed in claim 2, wherein said base end of the concave-shaped outlet of the injection cylinder and said convex-shaped inlet of the injection pipe cooperatively define non-parallel conical shape fitting ends of the respective injection cylinder and the injection pipe.

4. A die casting machine as claimed in claim 1, wherein said injection cylinder and said injection pipe are formed together as a single ceramic body, so that said injection pipe extends outwardly from a side portion of said injection cylinder, and said injection cylinder has a bottom portion thereof which is held in said ceramic outer sleeve.

5. A die casting machine as claimed in claim 1, wherein said ceramic outer sleeve has narrower bottom parts which hold the bottom of the ceramic injection cylinder in position.

6. A die casting machine as claimed in claim 1, wherein said ceramic outer sleeve has a pair of rectangular-shaped holes oppositely arranged in a diametrical direction thereof and a separate bottom plate which is held between said pair of holes, so that a bottom of said ceramic injection cylinder is held in position by said bottom plate.

7. A die casting machine as claimed in claim 1, wherein said flange is made of metal or thermet which has a thermal expansion coefficient smaller than 2 times and larger than 0.5 times a thermal expansion coefficient of a ceramic material of said outer sleeve.

8. A die casting machine as claimed in claim 1, wherein the said fixed support structure has an inner flange portion to which said metallic or thermet flange with said ceramic outer sleeve is fixed and said fixed support structure also holds an injection hydraulic cylinder for actuating said ceramic plunger.

9. A die casting machine as claimed in claim 2, wherein said injection cylinder has a concave conical cone at the molten metal outlet and said separated injection pipe has a convex conical cone at the molten metal inlet, said seal ring is disposed between these cones, and the cone of the injection cylinder has a smaller vertical angle ($\beta$) than a vertical angle ($\alpha$) of the cone of the injection pipe.

10. A die casting machine as claimed in claim 2, wherein said seal ring is placed between said concave outlet of said injection cylinder and said convex inlet of said injection pipe and has a cross-section of polygonal shape.

11. A die casting machine as claimed in claim 2, wherein a cross-section shape of the molten metal outlet of said injection cylinder is a concave conicoid and a cross-section shape of the molten metal inlet of said injection pipe is a convex conicoid.

12. A die casting machine as claimed in claim 2, wherein said seal ring is made of either one of thermets, ceramics, carbon composites including graphite, stainless steels, heat resistant steels having a property of being partially and permanently deformable by a sealing force at the temperature of a molten aluminum or its alloy and also the seal material can be coated with a coating material having an erosion resistant property against the molten aluminum or its alloy.

13. A die casting machine as claimed in claim 12, wherein said partially and permanently deformable seal ring is made of a material having a plastic deformation property.

14. A die casting machine as claimed in claim 12, wherein said partially and permanently deformable seal ring is a member having a partially collapsible property.

15. A die casting machine as claimed in claim 9, wherein the vertical angle ($\beta$) of the concave conical cone at the molten metal outlet of said injection cylinder is 20° to 80° smaller than the vertical angle ($\alpha$) of the convex conical cone at the molten metal inlet of said separated injection pipe.

16. A die casting machine as claimed in claim 2, wherein a protection ring is placed between said seal ring and said molten metal outlet of the injection cylinder, so that said seal ring is protected from a high speed molten metal coming out from said injection cylinder.

17. A die casting machine as claimed in claim 2, wherein said injection cylinder is provided at said concave-shaped molten metal outlet with a cap inserting recess and a cap placed at a tip of said injection pipe is inserted into said recess, so that said cap is located next to said seal ring, said cap has a perforated hole so that the molten metal coming out from said injection cylinder enters into the injection pipe without hitting the seal ring, thus the seal ring is protected from erosion by high speed molten metal.

18. A hot chamber die casting machine for casting aluminum and its alloys, comprising:

a container for containing therein a molten metal of aluminum or its alloys;

means for heating said molten metal in the container;

a ceramic cylinder constituting a pump body, at least a part of said cylinder being dipped in said container;

a ceramic plunger arranged for reciprocation in said cylinder and operable to inject the molten metal through a ceramic injection pipe and a runner into a die cavity;

means for holding said cylinder, said holding means comprising a ceramic outer sleeve which has sustaining means for holding said injection cylinder constituting a pump body by enclosing a lower part of said injection cylinder in the molten metal, a metallic or thermet flange arranged outside of the molten metal in the container and holding said outer sleeve and a fixed support structure arranged outside of and independent from said container and said heating means, so that said flange is fixed to said fixed support structure; and said ceramic outer sleeve has narrower bottom parts which hold the bottom of the ceramic injection cylinder in position.

19. A hot chamber die casting machine for casting aluminum and its alloys, comprising:

a container for containing therein a molten metal of aluminum or its alloys;

means for heating said molten metal in the container;

a ceramic cylinder constituting a pump body, at least a part of said cylinder being dipped in said container;

a ceramic plunger arranged for reciprocation in said cylinder and operable to inject the molten metal through a ceramic injection pipe and a runner into a die cavity;

means for holding said cylinder, said holding means comprising a ceramic outer sleeve which has sustaining means for holding said injection cylinder constituting a pump body by enclosing a lower part of said injection cylinder in the molten metal, a metallic or thermet flange arranged outside of the molten metal in the container and holding said outer sleeve and a fixed support structure arranged outside of and independent from said container and said heating means, so that said flange is fixed to said fixed support structure;

said ceramic outer sleeve has narrower bottom parts which hold the bottom of the ceramic injection cylinder in position; and said ceramic outer sleeve has a pair of rectangular-shaped holes oppositely arranged in a diametrical direction thereof and a separate bottom plate which is held between said pair of holes, so that a bottom of said ceramic injection cylinder is held in position by said bottom plate.

* * * * *